US008974321B2

(12) United States Patent
Schlamp

(10) Patent No.: US 8,974,321 B2
(45) Date of Patent: Mar. 10, 2015

(54) GOLF TEE SETTING APPARATUS

(71) Applicant: Phil Schlamp, La Crete (CA)

(72) Inventor: Phil Schlamp, La Crete (CA)

(73) Assignee: Phil Schlamp, LaCrete, Alberta (CA)

( * ) Notice: Subject to any disclaimer, the term of this patent is extended or adjusted under 35 U.S.C. 154(b) by 0 days.

(21) Appl. No.: 13/830,980

(22) Filed: Mar. 14, 2013

(65) Prior Publication Data

US 2014/0274474 A1 Sep. 18, 2014

(51) Int. Cl.
*A63B 57/00* (2006.01)

(52) U.S. Cl.
CPC ..... *A63B 57/0031* (2013.01)
USPC ..... 473/386

(58) Field of Classification Search
CPC ..... A63B 57/0018; A63B 57/0037; A63B 2057/0018; A63B 2057/0025
USPC ..... 473/386, 387, 408, 283; D21/718; 81/44
See application file for complete search history.

(56) References Cited

U.S. PATENT DOCUMENTS

| | | | | |
|---|---|---|---|---|
| 2,950,110 | A * | 8/1960 | Slotta et al. | 473/386 |
| 3,074,719 | A * | 1/1963 | McKee | 473/386 |
| 3,671,037 | A * | 6/1972 | Murdock, Jr. | 473/386 |
| 4,660,837 | A | 4/1987 | Bressie | |
| 4,896,883 | A * | 1/1990 | Wagenknecht | 473/386 |
| 4,960,239 | A * | 10/1990 | Wait | 473/406 |
| 5,370,388 | A * | 12/1994 | Wehner | 473/386 |
| 5,643,113 | A * | 7/1997 | Rodgers | 473/386 |
| 5,672,121 | A | 9/1997 | Miller | |
| 5,857,927 | A | 1/1999 | Driscoll | |
| 6,428,429 | B1 * | 8/2002 | Lee | 473/386 |
| 6,932,722 | B2 | 8/2005 | Wood | |
| 7,086,972 | B2 | 8/2006 | Bainbridge | |
| 7,090,594 | B2 | 8/2006 | Kawashima | |
| 7,468,008 | B2 | 12/2008 | Shin | |
| 7,699,721 | B2 | 4/2010 | Godlove, II | |
| 7,850,550 | B2 | 12/2010 | Nania | |
| 2002/0183138 | A1 | 12/2002 | Malcolm | |
| 2003/0195060 | A1 * | 10/2003 | Wood | 473/386 |
| 2005/0261088 | A1 * | 11/2005 | Suwito | 473/386 |
| 2007/0042839 | A1 * | 2/2007 | Smith et al. | 473/386 |

* cited by examiner

*Primary Examiner* — Steven Wong

(57) ABSTRACT

An apparatus comprises an elongated body comprising a top end, a bottom end, a chamber extending away from the bottom end, a hole extending through the bottom end into the chamber, and a door to expose the chamber and an interior of the hole. The chamber retains a golf tee with the door in a closed position. The hole enables only a bottom portion of the golf tee to extend beyond the bottom end. An adjustment mechanism adjusts a depth of the chamber to position the golf tee to protrude a desired length out of the hole during placement of the golf tee into a tee ground. A retention mechanism urges the door into the closed position and enables the door to open with an upward movement of the apparatus after the golf tee has been placed into the tee ground.

17 Claims, 4 Drawing Sheets

GOLF TEE SETTING APPARATUS

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to sports equipment. More particularly, the invention relates to a tee setter.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon. It is believed that it sometimes may be difficult to set regular wooden or zero friction tees in some tee ground, and it may also be difficult setting these tees at a golfer's desired depth with consistency. Furthermore, a golfer may have no place to store tees between tee offs to keep the tees close at hand to generally avoid searching for tees.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that there are some currently available golf tee setters. It is believed that these current golf tee setters typically to not provide a place to store a tee in between use. Moreover, many of these current golf tee setters are bulky, and one may expect that the size of these tee setters may preclude these tees from being stored in an easily accessible manner.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A is a perspective side view of the tee setter in a closed position, and FIG. 1B is a partially transparent perspective side view of the tee setter in an open position;

FIG. 2A is a diagrammatic bottom view of a tee setter for a traditional tee, and FIG. 2B is a diagrammatic bottom view of a tee setter for a zero friction tee;

Figure 1A:
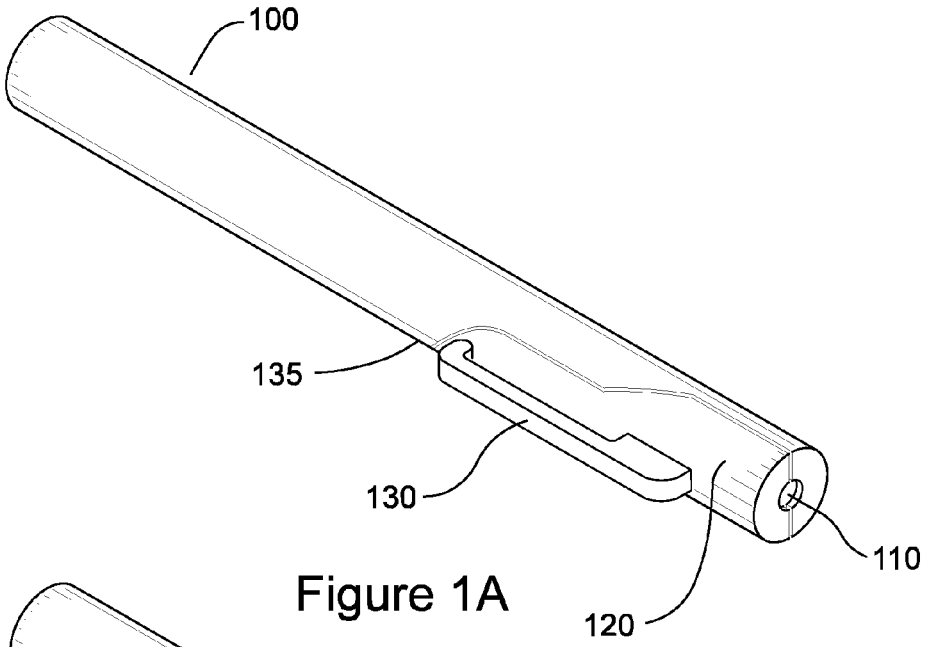
FIGS. 1A and 1B illustrate an exemplary tee setter, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

As is well known to those skilled in the art many careful considerations and compromises typically must be made when designing for the optimal manufacture of a commercial implementation any system, and in particular, the embodiments of the present invention A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

Some embodiments of the present invention relate to means for quickly and easily setting golf tees at the same desired depth consistently. One embodiment provides a device into which a tee is loaded, and in which a golfer's desired depth for the tee is set by a screw so that the tee can be set in the tee ground at the desired depth with ease. Some embodiments may also store the tee between uses in a manner that also makes the tee ready for setting at the next tee off. Some embodiments may be handily stored in a shirt or pants pocket with or without a loaded tee.

Figure 1B:
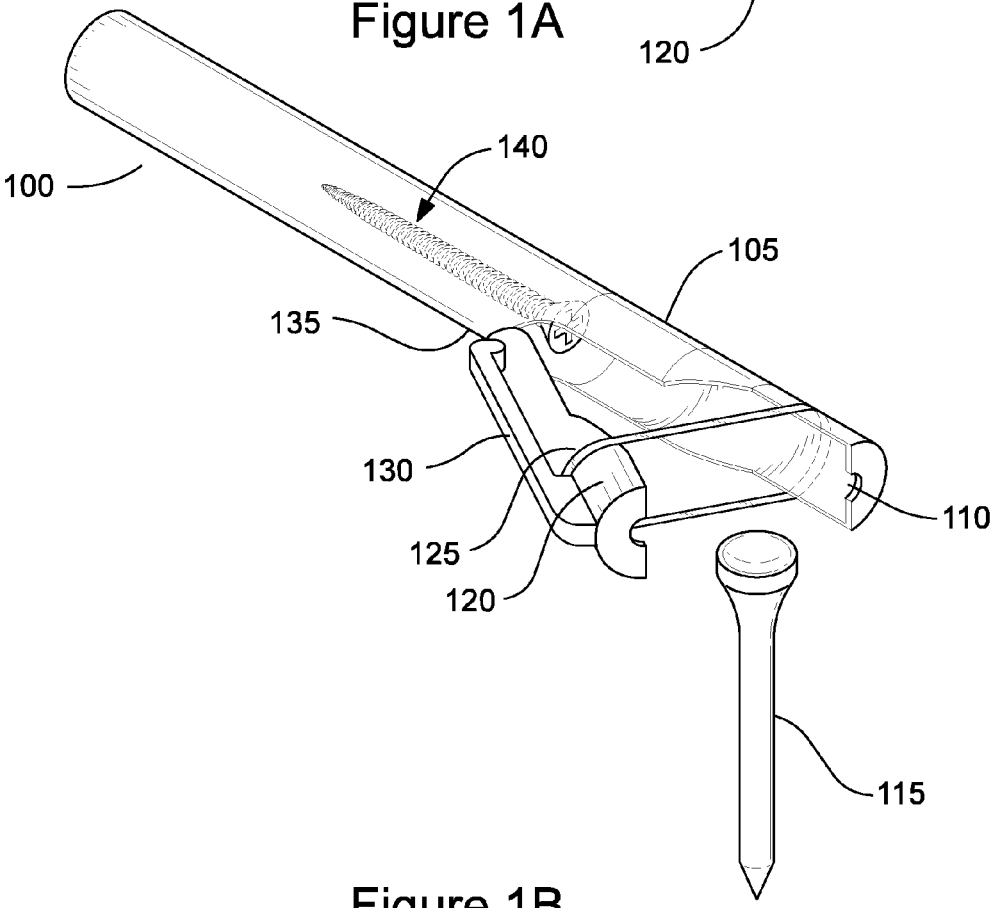

FIGS. 1A and 1B illustrate an exemplary tee setter 100, in accordance with an embodiment of the present invention. FIG. 1A is a perspective side view of tee setter 100 in a closed position, and FIG. 1B is a partially transparent perspective side view of tee setter 100 in an open position. In the present embodiment, tee setter 100 is approximately ⅝ of an inch in diameter and about the length of a ball point pen. It is contemplated that tee setter 100 may be made of a multiplicity of suitable materials such as, but not limited to, plastic, wood, metal, etc. Referring to FIG. 1B, the bottom portion of tee setter 100 comprises a hollow chamber 105. Chamber 105 extends up roughly 3 inches from the bottom of tee setter 100. In alternate embodiments, longer or shorter chambers may be used depending on the type of tee with which the tee setter is to be used. In the present embodiment, a hole 110 is drilled into the bottom of tee setter 100 just big enough for the stem of a golf tee 115 to pass through. Tee 115 may be a regular wooden or plastic tee or a zero friction tee. A door 120 is located in the bottom portion of tee setter 100. Referring to FIG. 1B, door 120 may be opened to typically enable tee 115 to be inserted into tee setter 100 and may close around tee 115 and hold tee 115 in place until tee 115 is set. Door 120 may be held shut by a rubber band 125 or by a clip 130. Clip 130 may be made of a slightly flexible material such as, but not limited to, metal or plastic and may be attached to door 120 so that clip 130 extends upward past a hinge point 135 of door 120. The flexibility of clip 130 typically enables door 120 to be opened to accept tee 115 and may provide pressure on door 120 to typically hold door 120 closed. Clip 130 may also be used to hold tee setter 100 firmly in a shirt or pants pocket or elsewhere, for example, without limitation, on the side or a golf bag or on a visor. In some embodiments, a hook and loop material may be used to hold the tee setter to another object. Some alternate embodiments may be implemented without a clip or with clips in various different locations which may or may not hold the door in a closed position. Some alternate embodiments may comprise a multiplicity of suitable means for holding the door in the closed position such as, but not limited to, a spring loaded mechanism, a clasp, magnets, etc. Some alternate embodiments may be implemented without a door and may use a retention device such as, but not limited to, a clip to hold the tee in place. Other embodiments may comprise various different means to hold the tee in place rather than a door including, without limitation, rubber bands, clips, straps, etc.

Referring to FIG. 1B in the present embodiment, at the upper portion of chamber 105 a screw 140 may be inserted into the upper portion of tee setter 100, which may comprise a threaded opening into which screw 140 may be screwed, with the threads of screw 140 going upward. When loading tee setter 100, tee 115 is typically inserted into chamber 105 until the head of tee 115 rests against the head of screw 140. To adjust the depth to which tee 115 is set, and thus to determine how high above the tee ground the ball will rest, screw 140 may be screwed in our out. Turning screw 140 clockwise reduces how far tee 115 is set into the tee ground and sets the ball higher off of the tee ground. Turning screw 140 counterclockwise sets tee 115 deeper into the tee ground so that the ball is closer to the tee ground. In some embodiments the screw may comprise a removable or permanently attached cap. Those skilled in the art will readily recognize, in light of and in accordance with the teachings of the present invention, that a multiplicity of suitable means may be used to adjust the depth at which the tee is set. For example, without limitation, in some embodiments the adjustable depth setting screw may be designed to come in from the top, or the tee setter may comprise a pin through the stem of the tee setter so that the pin may be used to change the depth the tee is set. In other embodiments a disc or other flat surface may be movably attached within the tee setter near the same location as screw 140 in the present embodiment and held in the desired location by various different means such as, but not limited to, a pin, a set screw, a ratcheting mechanism, etc. Different types of depth adjusting means may be used in yet other embodiments including, without limitation, removable and replaceable spacers, inflatable bladders, telescoping shafts, etc. In some embodiments the depth of the placement of the tee may not be adjustable.

In the present embodiment, hole 110 in the bottom of chamber 105 is slightly tapered to be shaped like a funnel pointing downward. This may help open door 120 once tee 115 is set and the tee setter is being removed, as the tapered shape may enable hole 110 to more easily slide over the head of tee 115 as tee setter 100 is pulled upward. Furthermore, chamber 105 is typically large enough to insert a tee with little resistance. Thus tee setter 100 may typically be pulled free of tee 115 while leaving tee 115 firmly set in the tee ground at the desired depth. In the present embodiment a large portion of the bottom of tee setter 100 is flat so as to aid in ensuring accuracy in depth setting, as more surface area may generally prevent the end of tee setter 100 from sinking into soft tee ground, while typically enabling the diameter of tee setter 100 to be small enough to be comfortably stored in a shirt or pants pocket. The bottom surface of tee setter 100 is mostly flat except for the area near door 120, which may slant inward and upward so as to generally allow the head of tee 115 to be used to open door 120 to insert tee 115. In some alternate embodiments, the bottom surfaces may be configured differently with flat and slanted areas located in various different places. Some embodiments may comprise a completely flat surface. Furthermore, some embodiments may have a rounded bottom or a bottom with some rounded areas, for example, without limitation, the edges may be rounded. In some embodiments, a bottom may be shaped like a funnel pointing into the tee chamber from the bottom so one need only to place the head of the tee into the funnel and push to open the door to insert the tee.

In accordance with the present embodiment, tee setter 100 is simple to load, store, and use, and can enable golf tees to be quickly and easily set in virtually any type of tee ground, even in hard tee ground, at the same depth consistently. The depth at which tee 115 is set may be easily adjusted to the desired depth of the user by screw 140. In addition, tee setter 100 may be comfortably and handily stored in a shirt or pants pocket while not in use and can also store tee 115 within chamber 105 so that tee setter 100 is loaded and ready for use at the next tee off. Tee setter 100 may also safely straighten and set damaged tees with little danger to the user's hands.

In typical use of the present embodiment, tee setter 100 is first loaded with tee 115 by holding tee 115 at an angle so as to allow the head of tee 115 to be placed against the area of door 120 that is slanted inward and upward. Tee 115 is then used to open door 120 and is inserted until the top of tee 115 rests against the head of screw 140 in the upper portion of tee setter 100. Tee setter 100 is now loaded. To set tee 115, tee setter 100 is held so that the upper portion of tee setter 100 is in the palm of a user's hand with the forefinger resting against the bottom portion of tee setter 100 on the opposite side of door 120. When tee 115 touches the ground, the forefinger may be used to put slight pressure against tee 115 to generally prevent tee setter 100 from wobbling and opening door 120. It is contemplated that some users may hold tee setter 100 differently when setting tee 115. Once tee 115 is at the ground, the user then pushes down on tee setter 100 to set tee 115 into the ground. The head of screw 140 pushes down on the head of tee 115 to force tee 115 into the ground. Tee 115 is set to the desired depth once the bottom of tee setter 100 is firmly against the ground. The height of tee 115 from the ground is roughly equal to the distance from the bottom of tee setter 100 to the head of screw 140, and tees may be set to this height repeatedly unless the user adjusts screw 140. Once tee 115 is set, tee setter 100 may be pulled straight up and away from tee 115 which is usually held fast by the tee ground. As tee setter 100 is pulled upward, door 120 typically opens automatically from the pressure of the head of tee 115 to generally enable tee setter 100 to be removed leaving tee 115 set at the desired depth and ready to hold a golf ball. After use, tee setter 100 may be placed in a shirt or pants pocket or a in a golf bag, etc. After driving the ball, tee 115 may be removed from the ground and placed back into tee setter 100. In some instances, the user may be able to replace tee 115 without removing tee setter 100 from his pocket. Setting a tee in this way using tee setter 100 typically takes about 2-3 seconds and can set tees consistently at the precise desired depth. Moreover, damaged tees may sometimes be used in tee setter 100. When a damaged tee is placed in tee setter 100 and door 120 is shut, the relatively small diameter of chamber 105 may straighten the damaged tee and may enable the user to set the tee with little danger to the hands of the user.

Figure 2A:
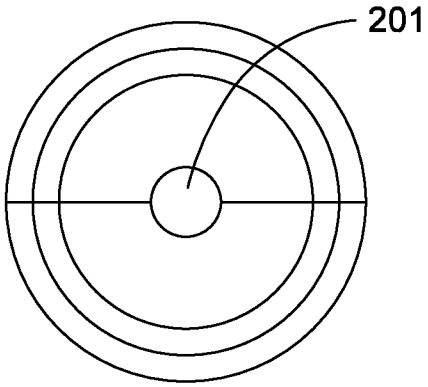
FIGS. 2A and 2B illustrate the bottom portions of exemplary tee setters, in accordance with embodiments of the present invention.
Figure 2B:
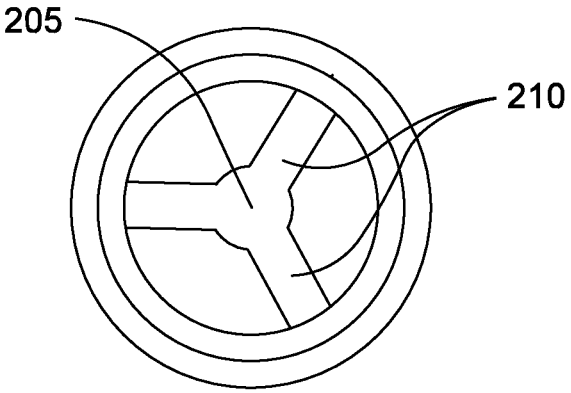

FIGS. 2A and 2B illustrate the bottom portions of exemplary tee setters, in accordance with embodiments of the present invention. FIG. 2A is a diagrammatic bottom view of a tee setter for a traditional tee, and FIG. 2B is a diagrammatic bottom view of a tee setter for a zero friction tee. Referring to FIG. 2A in the present embodiment, the bottom of the tee setter comprises a hole 201 through which a traditional tee may easily slide. A zero friction tee typically comprises three prongs to support a golf ball rather than a cup as found in a traditional tee. Therefore, referring to FIG. 2B, the bottom of the tee setter comprises a hole 205 surrounded by three notches 210. The shaft of the zero friction tee may fit into hole 205 and the prongs may slide through notches 210. Those skilled in the art will readily recognize, in light of and in accordance with the teachings of the present invention, that traditional tees may be used in tee setters for zero friction tees and vice versa. Moreover, the bottoms of some tee setters may be implemented with various different configurations.

Figure 3:
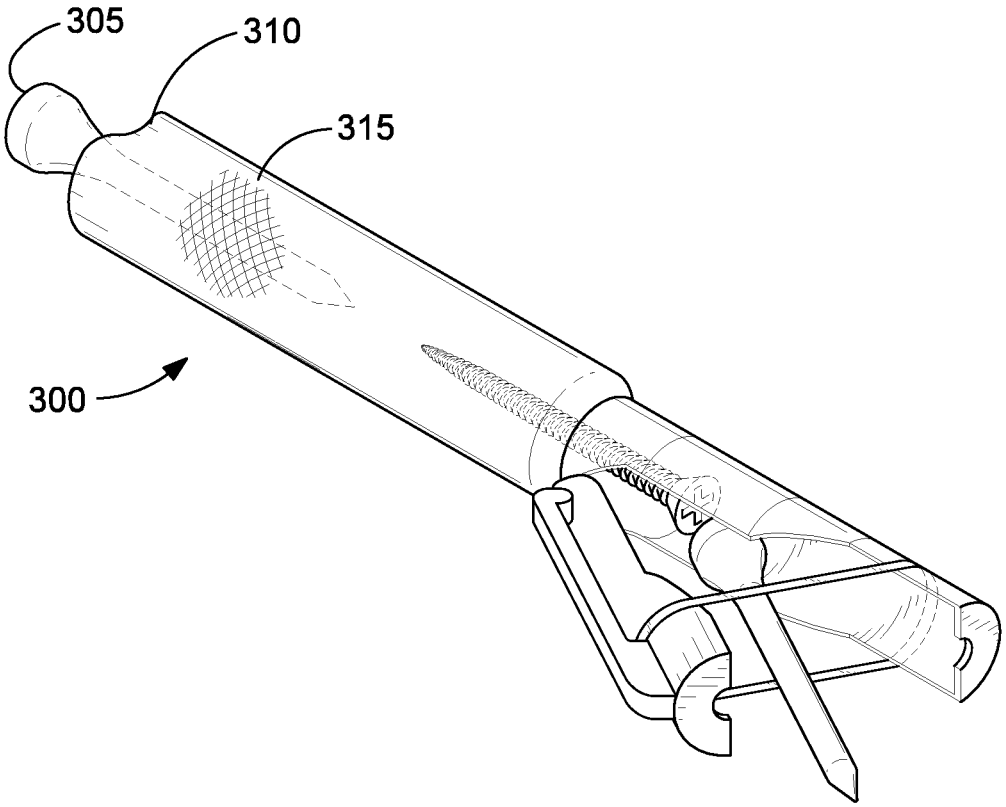
FIG. 3 is a side perspective view of an exemplary tee setter that may store an extra tee, in accordance with an embodiment of the present invention.

FIG. 3 is a side perspective view of an exemplary tee setter 300 that may store an extra tee 305, in accordance with an embodiment of the present invention. In the present embodiment, tee setter 300 comprises a cavity in the upper portion of a handle 310 into which extra tee 305 may be inserted and held. It is contemplated that this cavity may be used to hold a multiplicity of suitable items such as, but not limited to, a pencil or pen, a rolled up scorecard, a ball, ball markers, etc. Handle 310 also comprises a textured or non-slip covering 315 which may help to provide added grip when setting a tee, particularly in wet conditions.

Figure 4:
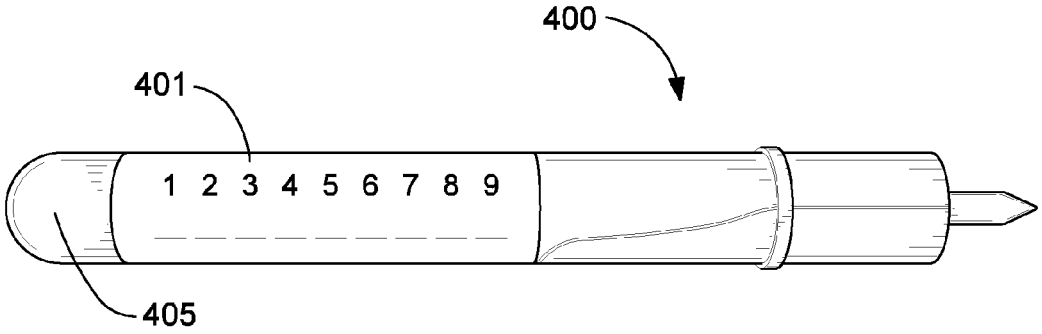
FIG. 4 is a perspective side view of an exemplary tee setter comprising a score card, in accordance with an embodiment of the present invention.

FIG. 4 is a perspective side view of an exemplary tee setter 400 comprising a score card 401, in accordance with an embodiment of the present invention. In the present embodiment, score card 401 is a paper cylinder that may slip over a handle 405 of tee setter 400. Score card 401 may typically eliminate the need to carry and store a separate score card or the need to repeatedly go to a golf cart to score. In some embodiments the tee setter may comprise an electronic handle with which the score may be kept electronically. This electronic score card may be set to score for 9 or 18 holes and may be configured so that when each hole is scored the total is automatically tallied. In some applications, the pointed end of a tee may be used to push small buttons on the handle to enter the score. In some alternate embodiments, electronic handles may also be implemented to display various different types of information including, without limitation, a clock, a timer, weather conditions, hole parameters, etc. Those skilled in the art will readily recognize, in light of and in accordance with the teachings of the present invention, that some alternate embodiments may be implemented with a multiplicity of suitable features that may be inserted into or integrated into the tee setter such as, but not limited to, flashlights, divot replacers, wrist straps, lanyards, attachment straps of hook and loop material, radios, magnifying lenses, etc.

Other useful design variations may include, without limitation, providing tee setters of various different lengths and diameters. For example, in one embodiment, the handle may be made long enough so that users do not have to bend over to set a tee. In some embodiments with a longer handle, a golf ball setting attachment may be located on the end of the handle opposite the tee setter, so that after setting the tee, the tee setter may be turned end for end to set a ball on the tee and release the ball once in place. This may be especially helpful for older or handicapped people. Some alternate embodiments may comprise telescoping handles or handles with adjustable lengths. The tee setters described in the foregoing largely refer to devices with cylindrical bodies. Some alternate embodiments may be implemented with various different shapes such as, but not limited to, bodies with rectangular, elliptical or triangular cross sections, and some embodiments may comprise ergonomic bodies that may aid a user in gripping the tee setter.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Having fully described at least one embodiment of the present invention, other equivalent or alternative methods of implementing a tee setter according to the present invention will be apparent to those skilled in the art. Various aspects of the invention have been described above by way of illustration, and the specific embodiments disclosed are not intended to limit the invention to the particular forms disclosed. The particular implementation of the tee may vary depending upon the particular context or application. By way of example, and not limitation, the tee setters described in the foregoing were principally directed to golf tee implementations; however, similar techniques may instead be applied to setting various different objects into the ground at a consistent depth such as, but not limited to, tent stakes, garden stakes, seedlings or seeds, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

What is claimed is:

1. An apparatus comprising:

an elongated body being dimensioned to fit in a pocket of a garment, said elongated body comprising a top end, a bottom end, a chamber extending upward away from said bottom end, a hole extending through said bottom end into said chamber, and a door being formed along a portion of a side of said elongated body to expose said chamber and an interior of said hole, said chamber being configured to be operable to retain a golf tee with said door in a closed position, said hole being configured to be operable to enable only a bottom portion of the golf tee to extend beyond said bottom end, wherein a diameter of said chamber and a diameter of said hole combine to straighten a damaged golf tee placed in the apparatus, in which said bottom end further comprises a plurality of notches about said hole to accommodate prongs of a zero friction golf tee;

an adjustment mechanism being configured to be operable to adjust a depth of said chamber to position the golf tee to protrude a desired length out of said hole during placement of the golf tee into a tee ground;

a clip being engaged with said elongated body, said clip being further configured to be operable to removably engage the apparatus with an object, in which said clip is further engaged with said door; and a resilient retention mechanism being configured to be operable to urge said door into said closed position and to enable said door to hinge open with an upward movement of the apparatus after the golf tee has been placed into the tee ground to release the golf tee.

2. The apparatus as recited in claim 1, further comprising a cavity disposed in said top end and being configured to be operable to store an additional golf tee.

3. The apparatus as recited in claim 1, further comprising a golf score keeping unit.

4. The apparatus as recited in claim 1, in which said resilient retention mechanism comprises at least an elastic band.

5. The apparatus as recited in claim 3, in which said golf score keeping unit is an electronic score card, said electronic score card is configured to automatically tally the score for 9 or 18 holes of golf played, wherein a pointed end of said golf tee is configured to push small buttons on the score card to enter the score.

6. The apparatus as recited in claim 1, in which said adjustment mechanism at least comprises a screw for rotatable adjustment of said depth, said screw is an adjustable depth setting screw, wherein said screw is configured to be operable to adjust a distance said golf tee is set into the tee ground, and wherein a clockwise rotation of said screw is operable to set a golf ball higher off of the tee ground and a counterclockwise rotation of said screw is operable to set said golf tee deeper into the tee ground so that the golf ball is closer to the tee ground.

7. The apparatus as recited in claim 1, in which said elongated body further comprises a textured surface.

8. The apparatus as recited in claim 1, in which said door bisects said hole.

9. The apparatus as recited in claim 1, in which said hole extending through said bottom end into said chamber is slightly tapered and being configured to be funnel shaped pointing downward, wherein said tapered shape is configured to enable said hole to slide over a head of a tee as the apparatus is pulled upward, living said tee on the ground.

10. The apparatus as recited in claim 1, in which said elongated body further comprises a cylindrical shape.

11. The apparatus as recited in claim 1, in which said elongated body is dimensioned to fit in a pocket of a garment.

12. An apparatus comprising:

an elongated body being dimensioned to fit in a pocket of a garment, said elongated body comprising a cylindrical shape having a textured surface, a top end, a bottom end, means being configured to be operable for retaining a golf tee within said elongated body, a hole extending through said bottom end into said retaining means, and means being configured to be operable for exposing said retaining means and an interior of said hole, said hole being configured to be operable to enable only a bottom portion of said golf tee to extend beyond said bottom end, wherein said retaining means and said hole combine to straighten a damaged golf tee placed in the apparatus, in which said bottom end further comprising a plurality of notches about said hole to accommodate prongs of a zero friction golf tee;

means being configured to be operable for adjusting a position of said golf tee to protrude a desired length out of said hole during placement of said golf tee into a tee ground;

means being engaged to said elongated body, being configured to be operable for removably engaging the apparatus to an object; and means being configured to be operable for urging said exposing means into said closed position and for enabling said exposing means to open with an upward movement of the apparatus after the golf tee has been placed into the tee ground to release the golf tee from the apparatus.

13. The apparatus as recited in claim 12, further comprising means being configured to be operable for storing an additional golf tee.

14. The apparatus as recited in claim 12, further comprising means for keeping a golf score.

15. An apparatus comprising:

an elongated body being dimensioned to fit in a pocket of a garment, said elongated body comprising a cylindrical shape having a textured surface, a top end, a bottom end, a chamber extending upward away from said bottom end, a hole extending through said bottom end into said chamber, and a door being formed along a portion of a side of said elongated body to expose said chamber and an interior of said hole, said door bisecting said hole, said chamber being configured to be operable to retain a golf tee with said door in a closed position, said hole being configured to be operable to enable only a bottom portion of the golf tee to extend beyond said bottom end, in which a diameter of said chamber and a diameter of said hole combine to straighten a damaged golf tee placed in the apparatus, said bottom end further comprising a plurality of notches about said hole to accommodate prongs of a zero friction golf tee;

an adjustment mechanism at least comprising a screw being configured to be operable to rotatably adjust a depth of said chamber to position the golf tee to protrude a desired length out of said hole during placement of the golf tee into a tee ground;

a clip being engaged to said elongated body and being configured to be operable to removably engage the apparatus to an object; and a resilient retention mechanism comprising at least an elastic band and being configured to be operable to urge said door into said closed position and to enable said door to hinge open with an upward movement of the apparatus after the golf tee has been placed into the tee ground to release the golf tee from the apparatus.

16. The apparatus as recited in claim 15, further comprising a cavity disposed in said top end and being configured to be operable to store an additional golf tee.

17. The apparatus as recited in claim 15, further comprising a golf score keeping unit.

* * * * *